US007100740B2

(12) United States Patent
Newton

(10) Patent No.: US 7,100,740 B2
(45) Date of Patent: Sep. 5, 2006

(54) PORTABLE BOAT TRAILER LADDER

(76) Inventor: Brian Robert Newton, 10210 N. Benton St., Westminster, CO (US) 80020

( * ) Notice: Subject to any disclaimer, the term of this patent is extended or adjusted under 35 U.S.C. 154(b) by 0 days.

(21) Appl. No.: 10/829,612

(22) Filed: Apr. 20, 2004

(65) Prior Publication Data

US 2005/0230185 A1 Oct. 20, 2005

(51) Int. Cl.
*E06C 5/00* (2006.01)

(52) U.S. Cl. ..... 182/206; 182/127; 182/163; 182/95

(58) Field of Classification Search ..... 182/206, 182/205, 163, 165, 152, 127, 97, 95
See application file for complete search history.

(56) References Cited

U.S. PATENT DOCUMENTS

| | | | | | |
|---|---|---|---|---|---|
| 377,219 | A | * | 1/1888 | Harrington | 182/163 |
| 590,149 | A | * | 9/1897 | Webster | 182/33.2 |
| 781,898 | A | * | 2/1905 | McNaughton | 182/27 |
| 1,115,803 | A | * | 11/1914 | Gallagher | 182/27 |
| 1,258,487 | A | * | 3/1918 | Smith | 182/27 |
| 2,086,280 | A | | 7/1937 | Matter | |
| 3,357,719 | A | | 12/1967 | McCrea | |
| 4,056,270 | A | | 11/1977 | Greenfield | |
| 4,401,184 | A | * | 8/1983 | Sherry | 182/45 |
| 4,652,003 | A | * | 3/1987 | Karashima | 280/166 |
| 4,846,303 | A | | 7/1989 | Cooper | |
| 4,943,076 | A | | 7/1990 | Tripke | |
| 5,039,119 | A | | 8/1991 | Baughman | |
| 5,042,614 | A | * | 8/1991 | Rainey | 182/22 |
| 5,113,782 | A | | 5/1992 | McCarty | |
| 5,725,070 | A | | 3/1998 | El dred | |
| 5,799,961 | A | | 9/1998 | Schmeets | |
| 5,896,946 | A | | 4/1999 | Brackett | |
| 6,138,794 | A | | 10/2000 | Staal | |
| 6,386,318 | B1 | | 5/2002 | Smith | |
| 6,422,344 | B1 | * | 7/2002 | Cox | 182/163 |
| 6,505,708 | B1 | | 1/2003 | LaBrash | |
| 6,523,846 | B1 | | 2/2003 | Bennett et al. | |
| 6,550,575 | B1 | | 4/2003 | Spencer et al. | |
| 6,578,666 | B1 | | 6/2003 | Miller | |
| 6,622,822 | B1 | | 9/2003 | Langhoff et al. | |
| 2003/0145432 | A1 | | 8/2003 | Figura et al. | |

* cited by examiner

*Primary Examiner*—Alvin Chin-Shue
(74) *Attorney, Agent, or Firm*—Barber Legal; Craig Barber

(57) ABSTRACT

The present invention teaches a boat trailer ladder which may be easily secured to and moved along the trailer rails. A hook is dimensioned and configured to engage standard boat trailer rails. An A-frame ladder provides steps from an approximately the level of the trailer rails, or in alternative embodiments from approximately ground level, up for a distance above the trailer rails. The extra elevation gained by a user of ordinary size standing on an upper step is sufficient to allow them to reach the top surfaces of the boat.

9 Claims, 4 Drawing Sheets

PORTABLE BOAT TRAILER LADDER

STATEMENT REGARDING FEDERALLY FUNDED RESEARCH

This invention was not made under contract with an agency of the US Government, nor by any agency of the US Government.

FIELD OF THE INVENTION

This invention relates generally to ladders and specifically to a ladder for use with a boat trailer.

CROSS-REFERENCE TO RELATED APPLICATIONS

N/A

BACKGROUND OF THE INVENTION

Trailered boats present problems of scale for human beings. While there is art, discussed below, directed towards the goal of providing access to boat cockpits and raft decks either trailered or afloat, there are relatively few items directed to allowing human access to the exterior of a trailered boat. Such access is necessary for cleaning, for repairs and so on.

U.S. patent Publication No. 2003/0145432 issued Aug. 7, 2003 to Figura et al for HANDLE EXTENSION FOR CLEANING HARD TO REACH PLACES is a currently pending application which shows the extent of the problem faced by boat owners: it is hard to reach the top of a trailered boat. As a reaching device rather than a ladder, it is far from the present invention.

U.S. Pat. No. 6,622,822 issued Sep. 23, 2003 to Langhoff et al for BUNK LADDER teaches a ladder designed for the interior of a long haul truck., not the exterior of a boat trailer.

U.S. Pat. No. 6,578,666 issued Jun. 17, 2003 to Miller for PORTABLE SAFETY LADDER ASSEMBLY FOR A TRUCK TRAILER teaches another cargo trailer device. While it shows a ladder with hooks, the ladder is straight, the hooks are dimensioned and configured for a cargo trailer and located at the top of the ladder and various other differences remove this item from consideration.

U.S. Pat. No. 6,550,575 issued Apr. 22, 2003 to Spencer et al for UTILITY PERCH AND TRAILER teaches a sport trailer which itself converts to a platform or hunting blind.

U.S. Pat. No. 6,505,708 issued Jan. 14, 2003 to LaBrash for LADDER MOUNTING SYSTEM teaches another cargo trailer ladder with some form of hooks at the top.

U.S. Pat. No. 6,386,318 issued May 14, 2002 to Smith for J. C. LIFE LADDER is an example of another type of boat related ladder which is used to get from water to dock and is otherwise unrelated to the present invention.

U.S. Pat. No. 6,523,846 issued Feb. 25, 2003 to Bennett et al for TRAILER PLATFORM may be relevant to the present invention. It teaches a step of expanded metal which may be attached to a boat trailer in order to provide a step at the level of the trailer rails. It does not teach any form of ladder, is not easily movable and does not have similar attachments.

U.S. Pat. No. 6,138,794 issued Oct. 31, 2000 to Staal for PORTABLE SELF-ADJUSTING LADDER is an example of an A-frame ladder with feet adapted to use on flat ground and thus arguing away from use with a trailer rail.

U.S. Pat. No. 5,896,946 issued Apr. 27, 1999 to Brackett for BOARDING LADDER AND WINCH MOUNT SYSTEM FOR BOAT TRAILERS AND THE LIKE is an interesting design which shows a ladder with a circular section and a bracket on the foot, allowing easy access (the device is a boarding ladder) to a boat on a trailer. The device has a bracket which does not allow easy moving of the ladder and is not of a size and shape to allow it to be used along the trailer or to reach the top of a boat.

U.S. Pat. No. 5,799,961 issued Sep. 1, 1998 to Schmeets for QUICK-ATTACHABLE TRAILER STEP teaches a device rather like the '846 patent above, however, it teaches a bracket which may allow easier repositioning along trailer rails.

U.S. Pat. No. 5,725,070 issued Mar. 10, 1998 to Eldred for TRAILER-BASED SUPPORT FRAME FOR USE IN VERTICALLY TRANSFERRING PERSONS AND EQUIPMENT teaches a ladder for descending into a man hole.

U.S. Pat. No. 5,113,782 issued May 19, 1992 to McCarty for Boat Boarding Ladder teaches a device for boarding a boat from water: it has a top dimensioned and configured to engage the boat.

U.S. Pat. No. 5,039,119 issued Aug. 13, 1991 to Baughman for RETRACTABLE STAIRS FOR VEHICLES and U.S. Pat. No. 5,005,850 issued Apr. 9, 1991 to Baughman for Retractable stairs for vehicles both teach stairs which may be permanently mounted on a bumper and retractable into a box.

U.S. Pat. No. 4,943,076 issued Jul. 24, 1990 to Tripke for SAFETY TRAILER STEP is a possibly relevant step having a bracket for mounting on a trailer rail, but not easily moved and not provided with any A-frame ladder.

U.S. Pat. No. 4,846,303 issued Jul. 11, 1989 to Cooper et al for TWO-POSITION LADDER is another device for boat boarding from the water.

U.S. Pat. No. 4,056,270 issued Nov. 1, 1977 to Greenfield to DEMOUNTABLE BOAT TRAILER STEP is another potentially relevant step also lacking easy methods of moving along the rails and lacking a step ladder for access to the top of the boat.

U.S. Pat. No. 3,357,719 issued Dec. 12, 1967 to S. E. McCrea for REMOVABLE STEP FOR A TRUCK CAMPER teaches yet another step, this one dimensioned and configured to attach to a bumper.

U.S. Pat. No. 2,086,280 issued Jul. 6, 1937 to A. J. Matter for SUPPORT shows an unrelated technology with a bracket.

U.S. Pat. No. D456,747 issued May 7, 2002 to Louie for BOAT TRAILER STEP is yet another step lacking easy traverse means, an A-frame ladder and so on.

U.S. Pat. No. D448,335 issued Sep. 25, 2001 to Ehnes for TIRE STEP ASSEMBLY teaches an interesting step which teaches towards attachment to a tire, and obviously cannot be moved freely along the length of a trailer.

U.S. Pat. No. D371,336 issued Jul. 2, 1996 to Wilson for STEP FOR BOAT TRAILER teaches a possibly relevant step which may be moved along a trailer rail but sill lacks an A-frame ladder.

It would be desirable to provide a ladder allowing access to the exterior of the boat, even the topsides exterior, when it is trailered.

It would further be desirable to provide such access to human beings of normal scale, by providing steps or standing surfaces substantially above ground level.

SUMMARY OF THE INVENTION

General Summary

The present invention teaches a boat trailer ladder which may be easily secured to and moved along the trailer rails. A hook is dimensioned and configured to engage standard boat trailer rails. An A-frame ladder provides steps from an approximately the level of the trailer rails, or in alternative embodiments from approximately ground level, up for a distance above the trailer rails. The extra elevation gained by a user of ordinary size standing on an upper step is sufficient to allow them to reach the top surfaces of the boat.

Summary in Reference to Claims

It is therefore one aspect, advantage, objective and embodiment of the present invention to provide a boat cleaning ladder comprising: a hook dimensioned and configured to physically engage with a rail of a boat trailer when clipped thereto, an A-frame step ladder having a first riser member and a second riser member both having a top and a foot, the first riser member being attached at its foot to the hook, the first and second riser members having a mutual connection to each other at their tops, a first step attached to the second riser member at approximately the foot of the second riser and a second step attached to the second riser member at approximately the top of the second riser member.

It is therefore another aspect, advantage, objective and embodiment of the present invention to provide a boat cleaning ladder further comprising at least one additional step attached to at least one riser at a point medial the foot and top of the riser.

It is therefore another aspect, advantage, objective and embodiment of the present invention to provide a boat cleaning ladder wherein the connection further comprises a hinge member allowing the two riser members to assume first and second positions relative to each other, wherein in the first position the two risers subtend an angle to each other, and in the second position the two risers are substantially parallel.

It is therefore another aspect, advantage, objective and embodiment of the present invention to provide a boat cleaning ladder wherein the connection comprises a third step disposed at the top end of both ladders.

It is therefore another aspect, advantage, objective and embodiment of the present invention to provide a boat cleaning ladder further comprising a lock to maintain the risers in the first position.

It is therefore another aspect, advantage, objective and embodiment of the present invention to provide a boat cleaning ladder wherein the lock further comprises a first hole through the first riser and a second hole through the second riser, and a locking pin disposed through the first and second holes.

It is therefore another aspect, advantage, objective and embodiment of the present invention to provide a boat cleaning ladder wherein the lock further comprises a first hole through the first riser and a second hole through the connection, and a locking pin disposed through the first and second holes.

It is therefore another aspect, advantage, objective and embodiment of the present invention to provide a boat cleaning ladder further comprising: a base member having a first end having a first attachment to the hook and having a second end having a second attachment to the foot of the second riser.

It is therefore another aspect, advantage, objective and embodiment of the present invention to provide a boat cleaning ladder further comprising a lock to maintain the risers in the first position.

It is therefore another aspect, advantage, objective and embodiment of the present invention to provide a boat cleaning ladder wherein the lock further comprises a first hole through the base member and a second hole through the second riser, and a locking pin disposed through the first and second holes.

It is therefore another aspect, advantage, objective and embodiment of the present invention to provide a boat cleaning ladder wherein the first attachment further comprises a second hinge member allowing the two base member to assume third and fourth positions relative to the second riser, wherein in the third position the second riser and base subtend an angle to each other, and in the second position the second riser and base are substantially parallel.

It is therefore another aspect, advantage, objective and embodiment of the present invention to provide a boat cleaning ladder wherein at least one member selected from the group consisting of: the first riser, the second riser, the base, the steps and combinations thereof further comprises a beam cross section.

It is therefore another aspect, advantage, objective and embodiment of the present invention to provide a boat cleaning ladder wherein the beam cross section further comprises one member selected from the group consisting of C-beams, I-beams, L-beams, V-beams, box beams, H-beams and combinations thereof.

It is therefore another aspect, advantage, objective and embodiment of the present invention to provide a boat cleaning ladder wherein at least one member selected from the group consisting of: the first riser, the second riser, the base, the steps and combinations thereof further comprises: at least one hole through the member, whereby the weight of the ladder is reduced.

It is therefore another aspect, advantage, objective and embodiment of the present invention to provide a boat cleaning ladder wherein the base projects approximately horizontally from the hook, whereby the step at the foot of the second riser is substantially at the level of the trailer rail, and further wherein the length of the risers is a first length such that when the hook is clipped to the trailer rail, a user of ordinary size may stand thereon and conveniently reach the top surfaces of a typical boat disposed upon the trailer.

INDEX TO REFERENCE NUMERALS

Boat 2

Boat Trailer 4

Boat Trailer Rail 6

Invention Ladder 8
User 10
Preferred Embodiment 20
Hook 22
Hook Barb 22*a*
Hook Extension 22*b*
Hook Shaft 22*c*
First Riser 24
Connection/Step 26
Second Riser 28
Second Riser, Far Member 28'
Base 30
Base Lock Hole 32
Second Riser Lock Hole 34
First Hinge 36
Second Hinge 38
Bottom Step 40
Middle Step 42
Connection Lock 52

DETAILED DESCRIPTION

Figure 1:
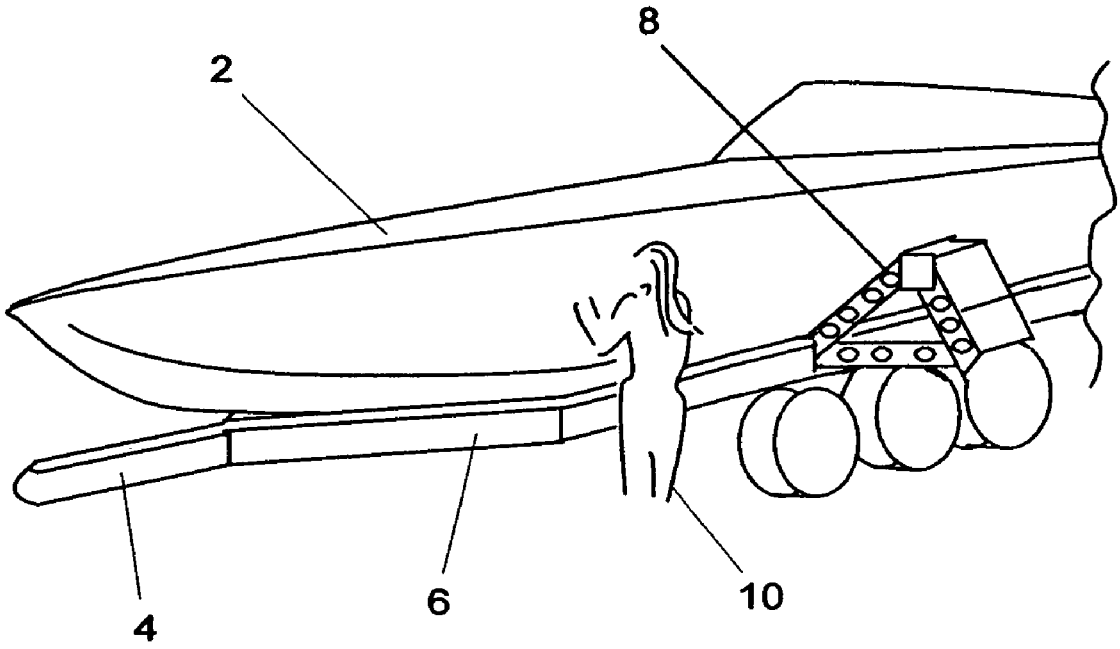
FIG. 1 is a view of a boat on a boat trailer showing a human being for rough scale and showing the invention in use.

FIG. 1 is a view of a boat on a boat trailer showing a human being for rough scale and showing the invention in use. Boat 2 is disposed upon boat trailer 4. Boat trailer rail 6 may be a structural member which supports the weight of the boat 2, and is customarily a box beam or the like with a dimension of a few inches per side.

Invention ladder 8 is a device for attachment to boat trailer rail 6 so that a user 10 who would ordinarily be unable to reach, let alone work on, the top surface of the boat will be able to do so.

Figure 2:
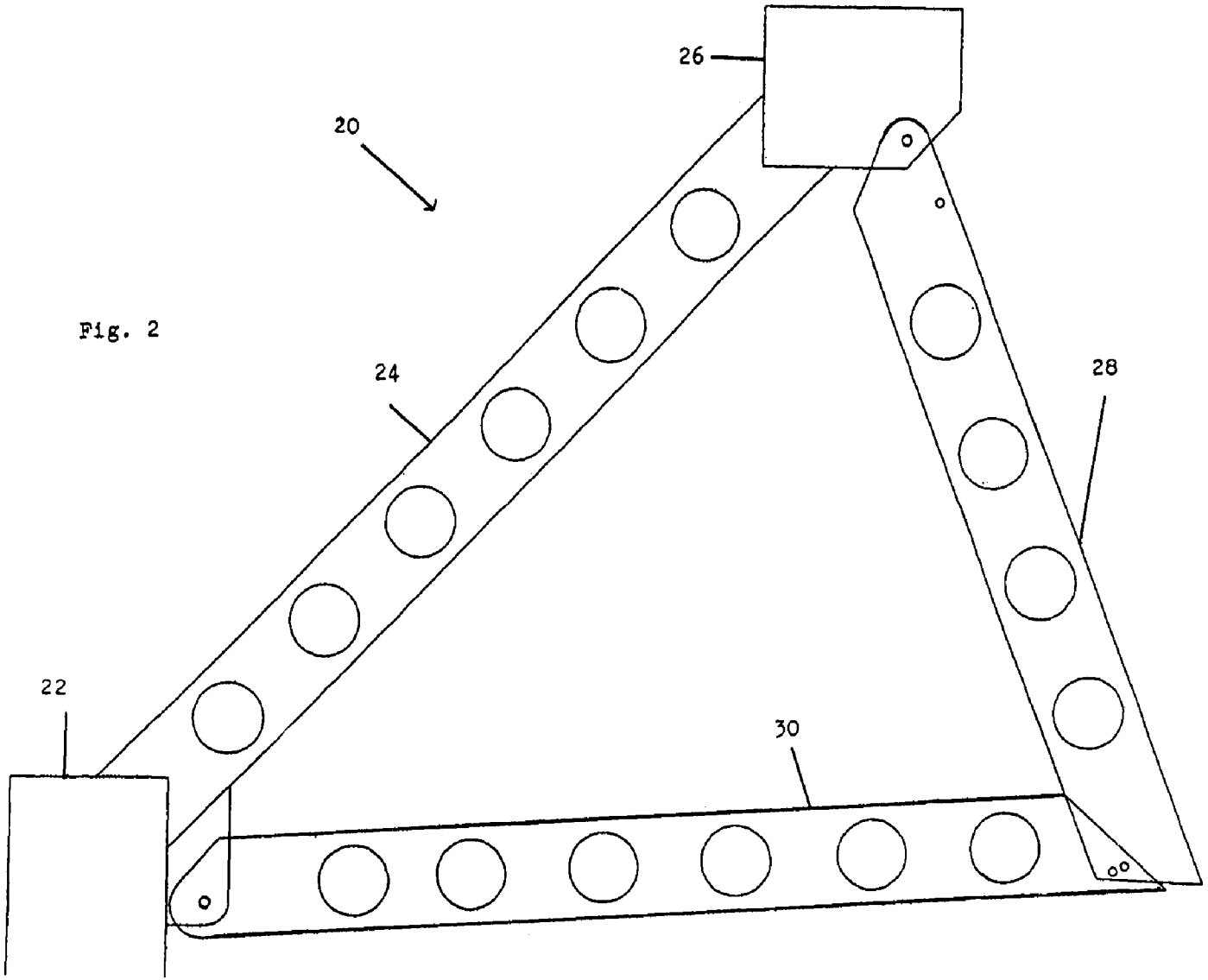
FIG. 2 is a large scale side view of the preferred embodiment of the invention in the position of use.
Figure 4:
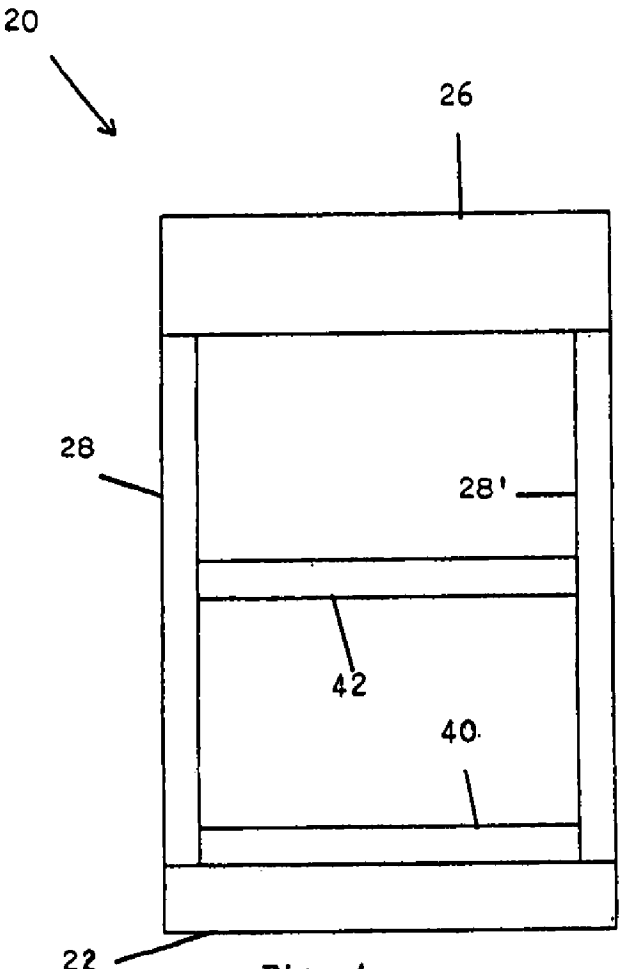
FIG. 4 is a front view of the invention in the folded position.
Figure 3:
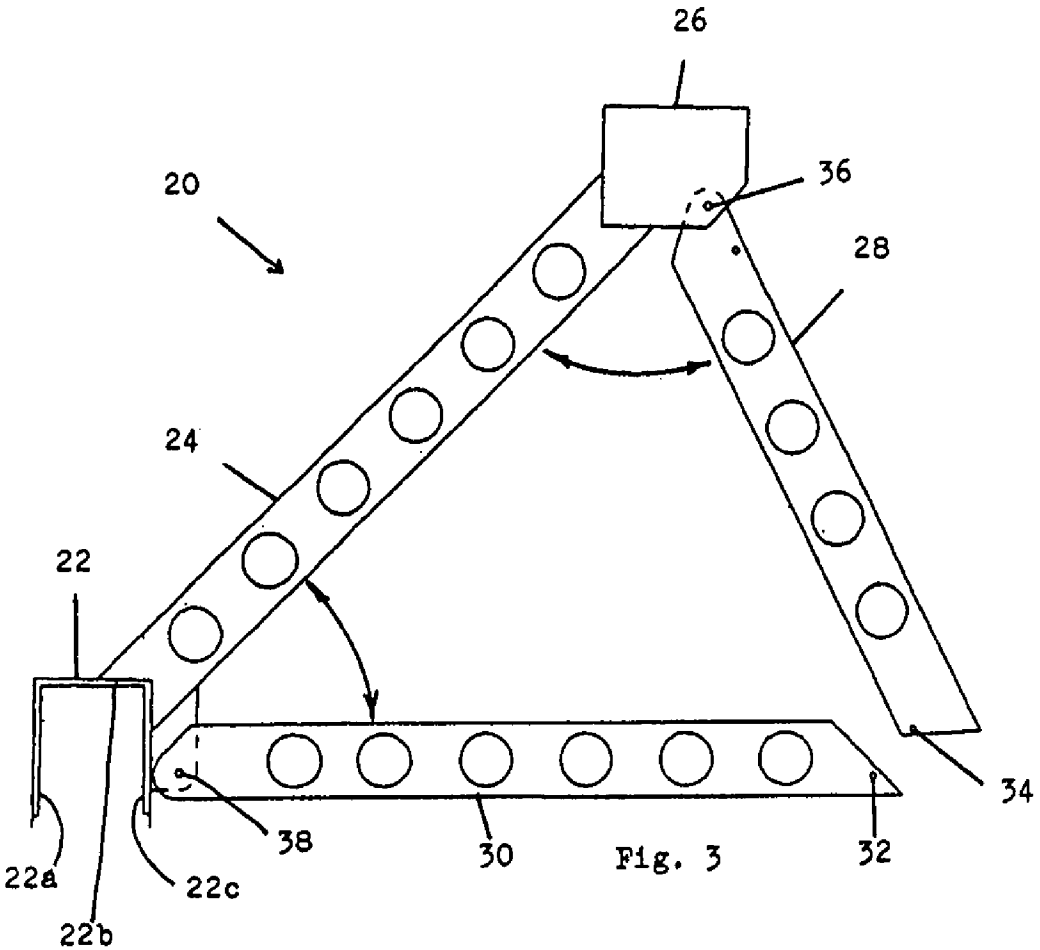
FIG. 3 is a small scale side view of the invention showing the angles through which the structural members move between the position of use and the folded position.

FIG. 2 is a large scale side view of the preferred embodiment of the invention in the position of use. FIG. 3 is a small scale side view of the invention showing the angles through which the structural members move between the position of use and the folded position. FIG. 4 is a front view of the invention in the folded position. Preferred embodiment 20 has hook 22 having hook barb 22*a*, hook extension 22*b* and hook shaft 22*c*. Hook 22 is dimensioned and configured to physically engage to trailer rail 6 by clipping thereto. "Clipping" in this application does not necessarily require any deformation of the hook and a "clicking" into place, on the contrary, fitting snugly is sufficient. If clearances between the various sub-components of the hook and the rail are narrow enough, a secure attachment is created without any physical change in shape by either item. Thus, it is advantageous in the preferred embodiment if the hook extension 22*b* has an interior length approximately equal to the width of the trailer rail 6, while hook barb 22*a* and hook shaft 22*c* may advantageously be of a length sufficient to provide strong anchor in torsion: that is, torque applied is absorbed by a relatively long member which may even be as long or longer than the depth of the trailer rail 6. Shape is also an element of the dimensioning and configuration of hook 22 to the trailer rail 6, as the shape should match the shape of several surfaces (not necessarily all surfaces) of the trailer rail 6.

One advantage of the present invention is that simply by placing the ladder's hook onto the rail, a secure hold may be obtained without clamping or bolting as shown in prior art. Another advantage is that the ladder of the invention may be "slid" along the rail without removing or un-clipping it, so that a user may easily work their way along the length of the boat trailer, for example, while cleaning the upper surface of the boat, without the need for continually removing the ladder to reposition it.

First riser 24 is connected via connection/step 26 to second riser 28. As will be seen by reference to FIG. 4, second riser has a far member 28': each of the risers, and the base, are in the preferred embodiment two members, one on each side of the steps and connections therebetween. In other embodiments, only a single member may be used for each riser and base, thus saving weight and materials, but at the expense of having steps which are cantilevered from a single end.

Base 30, like the riser members, and other parts of the invention, may be made of a strong metal or plastic. In the preferred embodiment, a T6061 aluminum billet stock may be used, machined by a water jet. In alternative embodiments, other materials may be used: less expensive metals, sturdy polymers, composites, wood, and the like.

For reasons of economics, classes of sturdy polymers may be used in order to reduce costs and ease manufacturing burdens. For example, a heavy gauge plastic may be used: after creation of molds, pieces may be stamped out for extremely low cost using various types of polycarbonates, HDPEs, etc. In other embodiments, the invention may be constructed from standard plastic girder members already available on the market. In yet other embodiments, plastic members may be reinforced with metal, for example, metal rods in the structure, a metal frame, or the like.

In the embodiment pictured, the "base" member does not touch the ground but rather projects roughly horizontally from the rail, thus presenting the image of the "base" of a triangle. In the preferred embodiment, there is no need for any part of the invention to touch the ground.

Base lock hole 32 and second riser lock hole 34 may overlap when the device is in the use position, so that a straight pin may be inserted therethrough and the device held in position. In alternative embodiments, the holes may not overlap and thus the pin may need to be of a special shape to extend through both. In yet other embodiments, other locking mechanisms may be used: hooks, stops, struts, and a wide variety of other devices within the scope of the invention may be used to support the invention.

First hinge 36 and second hinge 38 allow the various parts to move as shown by arrows in FIG. 3, so that as shown in FIG. 4, the device may be folded into a compact shape with risers and base member parallel and in embodiments, nested within one another.

An A-frame shape is created when first and second risers are positioned in the use orientation: the two risers ascend at angles and thus in side view, make the two outside risers of the English letter "A".

Bottom step 40, middle step 42 and connection/step 26 are surfaces for a user to step on. Bottom step 40 is in the best mode now contemplated at approximately the level of the trailer rail 6, or a bit lower or higher, thus making a first "off ground" step. Later steps may ascend higher by intervening distances chosen for user comfort and convenience, to a height which may vary from embodiment to embodiment. Certain large and powerful boats are very high, and thus may require more steps and/or steps further apart, while more normal boats may be tended by means of a device having only a step or two higher than the bottom of the step.

Risers 24 and 28 may have foot ends and top ends, the connection 26 being at the top end and the bottom step 40 being at the bottom end, however, location of these components at these locations is not required in alternative embodiments.

Figure 5:
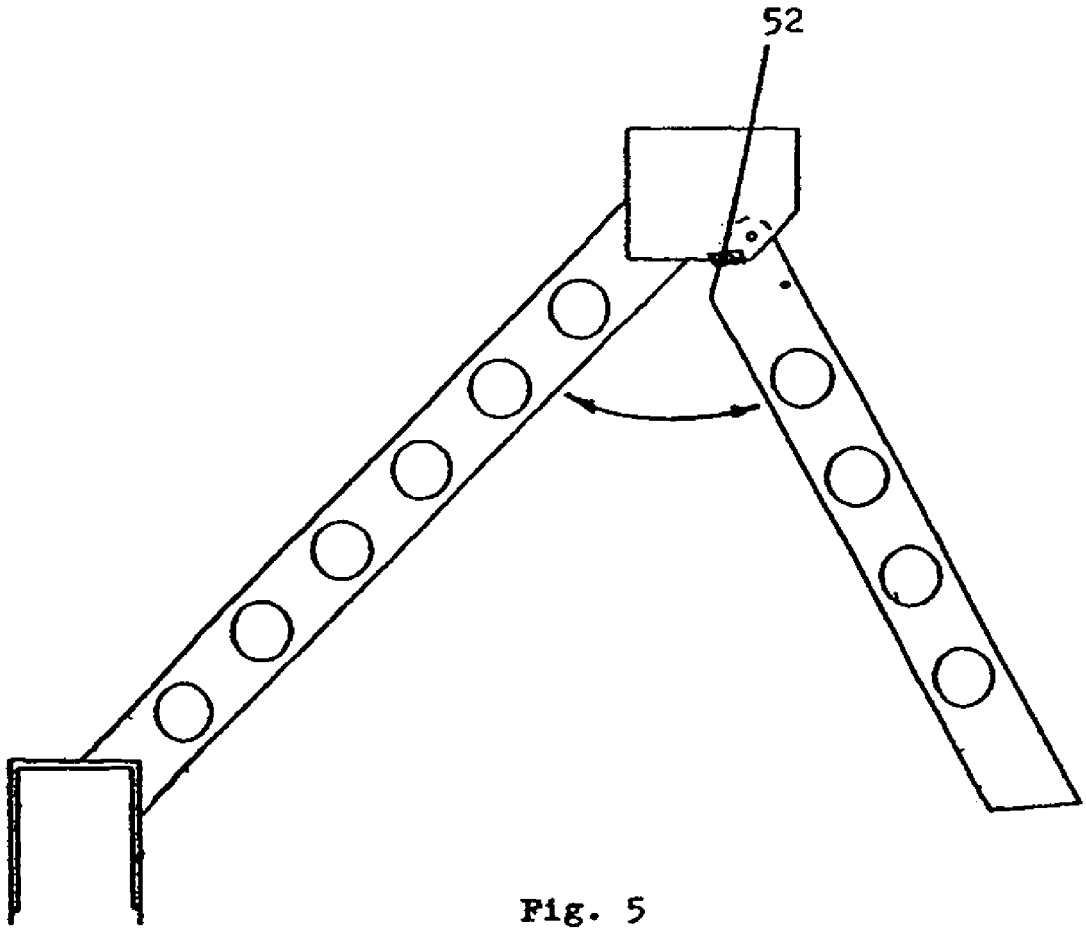
FIG. 5 is a side view of an alternative embodiment of the invention with no base.

FIG. 5 is a side view of an alternative embodiment of the invention with no base. This is an A-frame ladder with no base member. Weight is reduced but structural considerations may render this variation unsuitable for use: as of the application date, tested embodiments have all had bases.

One aesthetic consideration is that the device may advantageously be colored to match the trailer or boat of the user/owner. In a metal embodiment of aluminum, this involves use of a lacquer coat or other paint which may adhere to aluminum, while in other embodiments more ordinary paints may be used. In yet other embodiments such as those of plastic, the material itself may be provided in a suitable color, coordinated colors, a series of colors, etc. This is another economic advantage of the use of plastic: the ability to change colors for extremely low cost.

In this less preferred embodiment, connection lock 52 is necessary in order to maintain the device in the use configuration rather than the folded configuration.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

I claim:

1. A boat cleaning ladder for use on a boat trailer rail having a boat trailer rail width and a boat trailer rail depth, the boat cleaning ladder comprising:

a hook dimensioned and configured to physically engage with such boat trailer rail when clipped thereto, an A-frame step ladder having a first riser member and a second riser member both having a top and a foot, said hook being non-movably fixed to the foot of the first riser member for supporting the A-frame step ladder on the boat trailer rail in a cantilever manner, the first and second riser members having a mutual connection to each other at their tops, a first step attached to the second riser member at approximately the foot of the second riser and a second step attached to the second riser member at approximately the top of the second riser member, wherein the connection comprises a hinge member allowing the two riser members to assume first and second positions relative to each other, wherein in the first position the two riser members subtend an angle to each other, and in the second position the two riser members are substantially parallel, a base member having a first end having a first attachment to the hook and having a second end having a second attachment to the foot of the second riser member, a lock comprising a first hole through the base member and a second hole through the second riser member, and a lock pin disposed through the first and second holes to maintain the two riser members in the first position.

2. The boat cleaning ladder of claim 1, further comprising at least one additional step attached to at least one riser at a point medial the foot and top of the riser.

3. The boat cleaning ladder of claim 1, wherein the connection comprises a third step disposed at the top end of both ladders.

4. The boat cleaning ladder of claim 1, wherein the first attachment further comprises a second hinge member allowing the base member to assume a use position and a folded position relative to the second riser, wherein in the use position the second riser and base subtend an angle to each other, and in the folded position the second riser and base are substantially parallel.

5. The boat cleaning ladder of claim 4, wherein at least one member selected from the group consisting of: the first riser, the second riser, the base, the steps and combinations thereof further comprises a beam cross section.

6. The boat cleaning ladder of claim 5, wherein the beam cross section further comprises one member selected from the group consisting of C-beams, I-beams, L-beams, V-beams, box beams, H-beams and combinations thereof.

7. The boat cleaning ladder of claim 1, further comprising at least one hole through the ladder, whereby the weight of the ladder is reduced.

8. The boat cleaning ladder of claim 1, wherein the base member projects approximately horizontally from the hook, whereby the step at the foot of the second riser is substantially at the level of the hook.

9. The boat cleaning ladder of claim 1, wherein the hook further comprises:

a hook extension having an interior length approximately equal to such boat trailer rail width;

a hook barb having a length at approximately as long as such boat trailer rail depth; and a hook shaft having a length approximately as long as such boat trailer rail depth.

* * * * *